United States Patent [19]

Trout

[11] 4,413,445

[45] Nov. 8, 1983

[54] SPRING-STRETCH-REDUCING WINDOW SASH BALANCE

[76] Inventor: Donald M. Trout, 19700 Woodward Ave., Detroit, Mich. 48203

[21] Appl. No.: 372,488

[22] Filed: Apr. 28, 1982

Related U.S. Application Data

[63] Continuation-in-part of Ser. No. 180,034, Aug. 21, 1980, abandoned.

[51] Int. Cl.[3] ..... E05D 13/10

[52] U.S. Cl. ..... 49/445

[58] Field of Search ..... 49/445, 446, 447, 448, 49/181

[56] References Cited

U.S. PATENT DOCUMENTS

| | | | |
|---|---|---|---|
| 2,774,119 | 12/1956 | Osten | 49/445 X |
| 2,825,090 | 3/1958 | Osten | 49/445 X |
| 3,091,797 | 6/1963 | Prosser | 49/445 X |
| 3,133,323 | 5/1964 | Robards | 49/181 X |
| 3,197,819 | 8/1965 | Trout | 49/181 X |
| 3,358,403 | 12/1967 | Dinsmore | 49/445 |
| 4,170,090 | 10/1979 | Wood | 49/181 X |
| 4,364,199 | 12/1982 | Johnson et al. | 49/181 |

*Primary Examiner*—Philip C. Kannan

*Attorney, Agent, or Firm*—Barnes, Kisselle, Raisch, Choate, Whittemore & Hulbert

[57] ABSTRACT

A sash coupling is adapted to be connected to one side of a sash which slides vertically in parallel channel sash guides mounted within a sliding sash window frame. Secured to the top of the sash coupling is the lower end of a flexible sash cable, the outer end of which extends upward to and around a stationary outer pulley pivotally mounted on a transverse pulley support at the top of the sash guide, whence an intermediate section of the cable extends downward to and around a vertically-movable traveling pulley mounted on a balancing-spring coupling to which the upper end of the elongated sash-balancing tension spring is hooked, whence an inner section of the cable extends upward to an anchorage on the upper end of the sash guide. The lower end of the elongated sash-balancing spring is hooked over the lower end of the sash guide. For a double-hung sliding sash installation, the upper sash is balanced in a similar manner. For By arranging in this manner the sash cable in three sections around two pulleys, the stretch of the sash balancing spring is reduced to but a fraction of the distance through which the sash is moved during the opening operation thereof. This is in contrast to the much greater stretch with a consequently greater varation in the balancing force applied to the sash by a single elongated sash balancing spring stretched directly between the sash and the top of the channel sash guide.

4 Claims, 10 Drawing Figures

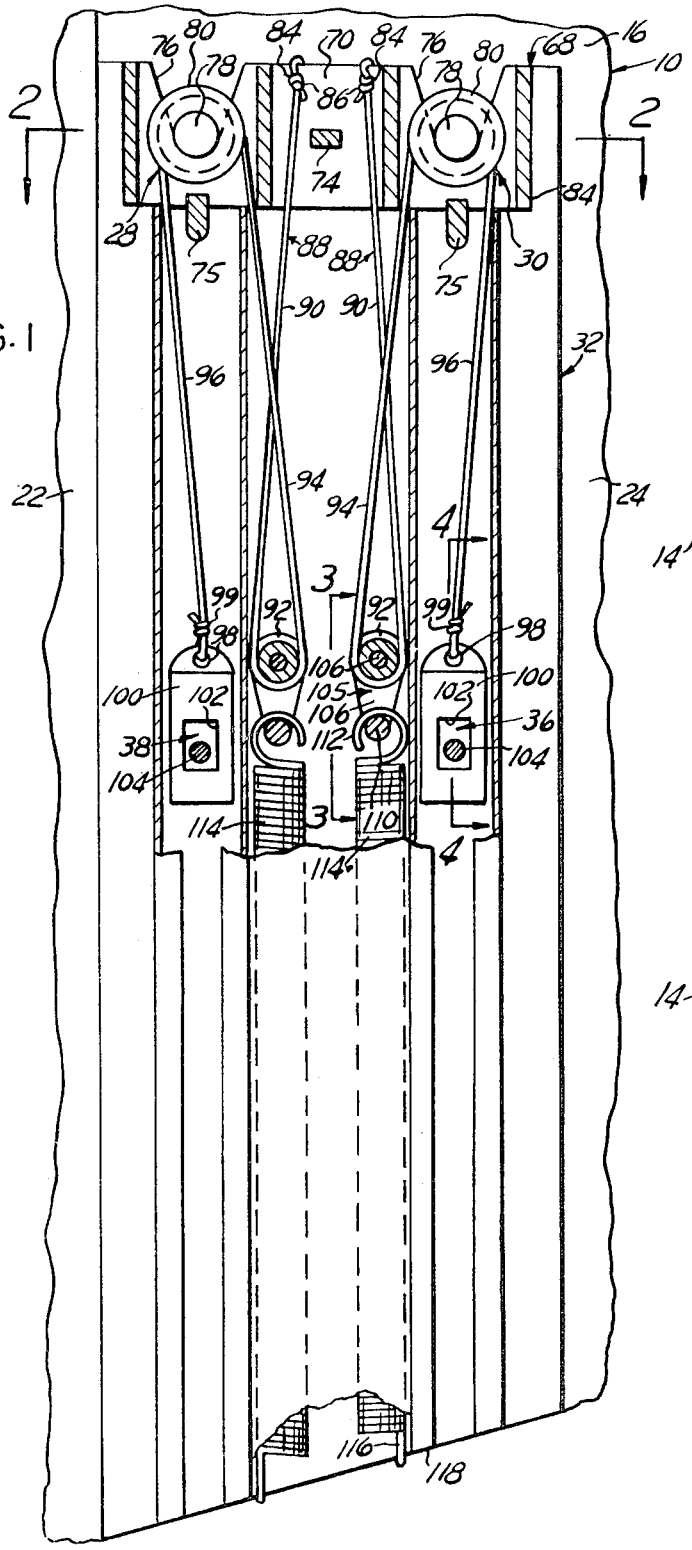
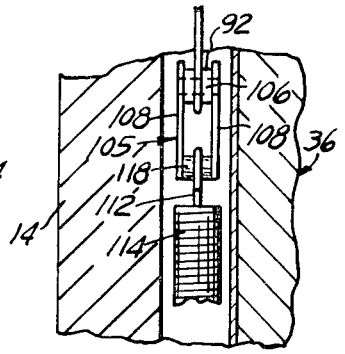
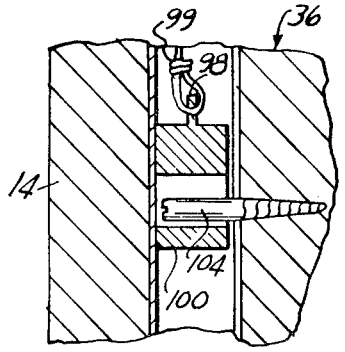
FIG. 4

SPRING-STRETCH-REDUCING WINDOW SASH BALANCE

This is a continuation-in-part of my copending application, Ser. No. 180,034, filed Aug. 12, 1980, now abandoned.

BACKGROUND OF THE INVENTION

In the prior art, the sashes of sliding sash windows were originally balanced by cast iron sash weights connected to cables passing over and around pulleys at the upper end of the window frame. Subsequently, these sash weights were replaced by single elongated sash balancing tension springs with their upper ends connected to cables which passed upward to and around pulleys at the tops of the window frames and then downward to connections to the upper ends of the sashes. The lower ends of the sash balancing tension springs were anchored to the lower ends of the metal or plastic channel sash guides in which the sashes were adapted to slide upward and downward while their weights were balanced by the forces applied to the cables as the tension springs became increasingly stretched. Such installations, however, have been disadvantageous in that the springs required stretching beyond their elastic limits to such excessive lengths that when each sash was in a closed position, its spring was excessively stretched to exert unnecessary balancing force to the sash whereas when the sash was fully open, the spring was so relaxed as to apply insufficient balancing force to the sash, with the result that the sash tended to sag downward so as not to be fully closed.

The present invention provides a sash balance which distributes the balancing force of a shorter stretching balancing spring between several sections of cables passing around multiple upper and lower pulleys, thereby reducing the excessive stretching of the springs to or beyond their elastic limits and preventing such sash sagging resulting from such excessive spring stretching and consequent excessive variation of the balancing forces of the prior art single pulley sash balancing spring installations.

It is an object of the present invention also to provide an extremely simple and essentially miniature structure for the balancing mechanism with all plastic molded parts and tiny pulleys which serve to provide smooth operating conditions and which are readily assembled and maintained.

SUMMARY OF THE INVENTION

This invention resides primarily in the provision of single or double hung sashes slidably mounted in vertical channel sash guides and balanced by cables secured at their lower ends to the upper transverse sash members, thence passing upward to and around upper stationary pulleys mounted on a horizontal support transverse to the upper ends of the channel sash guide, thence downward to and around traveling pulleys connected to the upper ends of sash balancing springs anchored at their lower ends to the lower ends of the channel sash guides, the cables passing from the traveling pulley upward to anchorages at the upper end of the channel sash guide.

A small plastic molded part slips readily into a window channel to mount pulleys at the top of the channel and to serve as the anchor point for the flexible cables. Thus, all the essential parts are in a single molding at the top of the channel with exception of the split traveling hangers which mount small plastic pulleys.

In the drawings:

FIG. 1 is a vertical section through a spring sash balancing installation for a double-hung sliding sash window, partly broken away to disclose the construction behind the channel sash guide, and looking in the direction of the arrows 1—1 in FIG. 2;

FIG. 3 is a fragmentary vertical section looking in the direction of the arrows 3—3 in FIG. 1, and showing the connections of the traveling pulleys to the tops of the sash balancing springs; and FIG. 4 is a fragmentary vertical section looking in the direction of the arrows 4—4 in FIG. 1 showing the connection of one of the sash balancing cables to the top of one of the sliding sashes.

Figure 2:
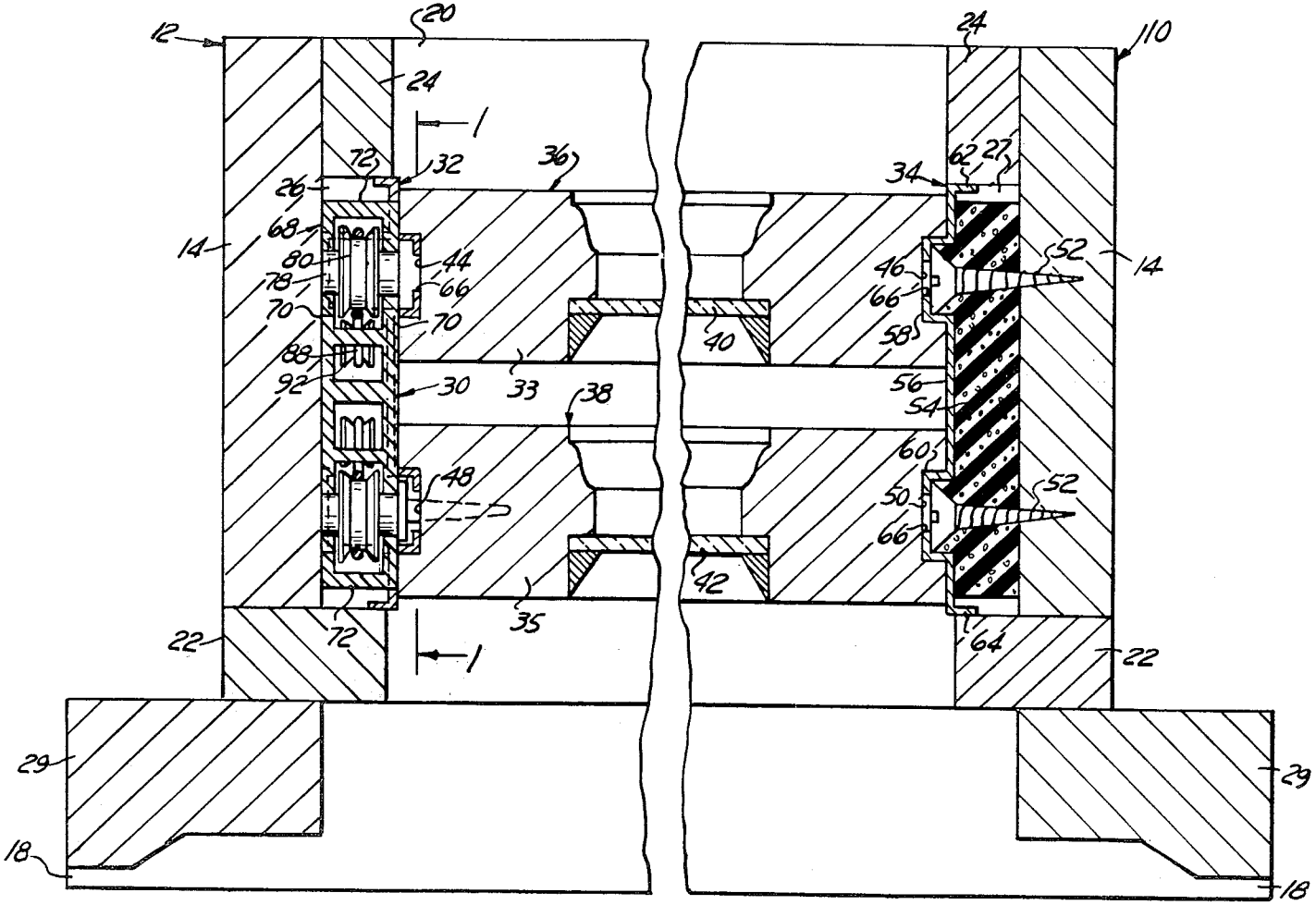
FIG. 2 is a horizontal section looking in the direction of the arrows 2—2 in FIG. 1, but showing the upper stationary pulleys in top plan view.

Referring to the drawings in detail, FIGS. 1 and 2 show a double-hung sliding sash window installation, generally designed 10, of a conventional type including a window frame 12 provided with opposite parallel vertical side members 14 connected at top and bottom by a top cross member 16 and bottom outer and inner sills 18 and 20 respectively. Parallel vertical outer and inner members 22 and 24 rise from the outer window sill 18 and abut the outer and inner faces of the side members 14, completing the formation of parallel vertical recesses 26 and 28 facing one another. Rising from the outer sill 18 and abutting the outer members 22 are parallel outer vertical members 29. Secured within the recess 26 is a channel sash guide 32 supporting inner and outer sash balancing devices 28 and 30 of similarly designated parts. Secured within the recess 27 is a channel sash guide 34. The channel sash guides 32 and 34 are preferably extrusions of metal, such as aluminum, or of plastic, such as polyvinyl plastic. Vertically slidably mounted in the sash guides 32 and 34 are rectangular sash frame structures 33 and 35 of inner and outer sashes 36 and 38 respectively provided with the usual lower and upper panes 40 and 42 respectively and also provided with spaced parallel vertical guide grooves 44 and 46 for the inner sash 36, and 48 and 50 for the outer sash 38.

Secured within the recess 28 between the sash guide 34 and the adjacent vertical member 14 by fasteners 52, such as wood screws, is an insulating strip or plate 54, preferably of resilient foam plastic, which not only provides insulation for the channel sash guide 34 but also resiliently urges the sash guide 34 and the sashes 36 and 38 toward the opposite channel sash guide and its sash balance 32. Each of the channel sash guides 32 and 34 consists of a central plate-like portion 56 from which project spaced parallel hollow ribs 58 and 60 of rectangular cross-section which slidably engage and guide the guide grooves 46 and 50 of the inner and outer sashes 36 and 38. The plate-like portion 56 terminates at its opposite vertical edges in inner and outer perpendicular flanges 62 and 64 respectively. Extending the entire length of the front face of each of the hollow ribs 58 and 60 is a slot 66 used by the sash balancing device 30. The sash guides 32 and 34 are thus of substantially identical construction and operation except that the sash guide 32 additionally serves to support and house the sash balancing device 30. Since the inner and outer sash balancing devices 28 and 30 are also of identical construction, a single description of both is believed to be sufficient, similar parts being designated with the same reference numerals.

The inner and outer sash balancing devices 28 and 30 (FIGS. 1 and 2) are suspended from and supported by an elongated hollow horizontal supporting cross bar 68 provided with spaced parallel side walls 70, opposite end walls 72 and intermediate upper and lower strengthening ribs 74 and 75. The side walls 70 are provided with two pairs of round-bottom Vee notches 76 (FIG. 1) extending downward from the tops of the side walls 70 in spaced parallel relationship. Dropped into the paired Vee notches 76 in the top of the cross bar 68 are the axles 78 of a pair of grooved pulleys 80. The top of the channel sash guide 32 is provided with a rectangular recess 82 with an open upper end and in which the hollow cross bar 68 is snugly but firmly mounted. One of the side walls 70 is drilled to provide a pair of horizontally-spaced holes 84 through which are tied and knotted at 86 the upper ends of sash balancing calbes, generally designated 88. Each cable 88 has an inner or first section 90 which proceeds downward around a grooved traveling pulley 92 from which an intermediate or second section 94 proceeds upward to and around the upper stationary grooved pulley 80, crossing the inner cable section 90 on the way. From the grooved pulley 80 an outer or third section 96 proceeds downward to and through a hole 98 in the upper end of a sash coupling block 100 to which it is secured by being tied in a knot 99. The sash coupling block 100 (FIG. 4) is provided with a rectangular aperture 102 through which extends a headless fastener such as a screw 104 into the vertical sash member 36 or 38 within the guide groove 44 or 48.

It will be seen that the sash guide has a back face seated against the frame member 14 with two vertical elongate side channels below the pulleys 80 with an intermediate central elongate vertical chamber behind a center panel to accommodate the springs. The center panel is spaced outwardly from the back face. The traveling pulley 92 is connected to a balancing spring coupling 105 by being rotatably mounted upon an axle 106 thereon. The axle 106 in turn is supported by and between a pair of parallel triangular plates or fingers 108 (FIGS. 1 and 3) extending downward therefrom. The lower ends of the plates 108 are joined to one another by a rivet-like pin 110 over which is secured the hooked movable end 112 of an elongated sash-balancing tension spring 114. The spring 114 is provided with a stationary looped opposite end 116 which is hooked around the inclined lower edge 118 of the sash guide 32.

In the operation of the invention, let it be assumed that the parts have been assembled in the above-described manner as shown particularly in FIGS. 1 and 2. Let it also be assumed that the sashes 36 and 38 are in their closed and balanced positions, and that the balancing springs 114 are in their stretched and tensioned positions, balancing and counteracting the weights of their respective sashes 36 and 38. Let is now be assumed that the inner sash is raised from its lowered position of FIGS. 1 and 2 to its raised and open position (not shown). While this occurs, the weight of the sash is counterbalanced by the pull on the coupling 100 and the outer section 96 of the cable 88 transmitted around the stationary pulley 80 and along the intermediate and inner sections 94 and 90 while the traveling pulley 92 is being drawn downward by its connection through the balancing spring coupling 105 by the downward pull of the tension of the balancing spring 114. At all times, the cable 88 is anchored at its upper end by being tied by the knotted connection 86 through the hole 84 in the hollow supporting cross bar 68.

To close the lower half of the window, the operator pulls downward upon the inner sash 36, the weight of which is constantly balanced by the tension of the respective balancing spring 114. As the inner sash 36 is pulled downward, its downward motion is transmitted to the sash coupling 100 and outer section 96 of the cable 88 by the engagement of the headless screw 104 with the upper edge of the aperture 102. The consequent downward travel of the outer cable section 96 is transmitted around the stationary pulley 80 to the intermediate cable section 94, which moves upward as the outer cable section 96 is pulled downward. The upward motion of the intermediate cable section 96 is transmitted by and around the traveling pulley 92 to the inner cable section 90 anchored at its upper end 86 to the hollow supporting cross bar 58 mounted on the upper end of the sash guide 32. While this occurs, the traveling pulley 92 and balancing spring coupling 105 are pulled upward toward the hollow supporting cross bar 68 by the motion of the sections 96, 94 and 90 of the cable 88, stretching and thereby tensioning the balancing spring 114 through its connection 112 and spring coupling 105 to the traveling pulley 92. As a consequence of the operation of the multiple pulley and cable construction just described, the sash balancing tension spring 114 is stretched only a fraction of the distance traveled by the inner sash 36 and sash coupling 100, with the result that the lessened stretching of the balancing spring 114 remains well within the elastic limits of the material of which the spring 114 is composed. This is in striking contrast to the excessive stretch imposed upon prior art single balancing springs which are stretched the same distance as the distance through which the sash moves during operation.

The action and operation of the spring sash balance 28 for the outer sash 38 is substantially the same as that just described for the inner sash 36 except that the outer sash 38 is opened by pulling downward upon it instead of raising it as in the case of the opening of the inner sash 36.

Reference is now made to the embodiment shown in FIGS. 5 to 10.

Figure 5:
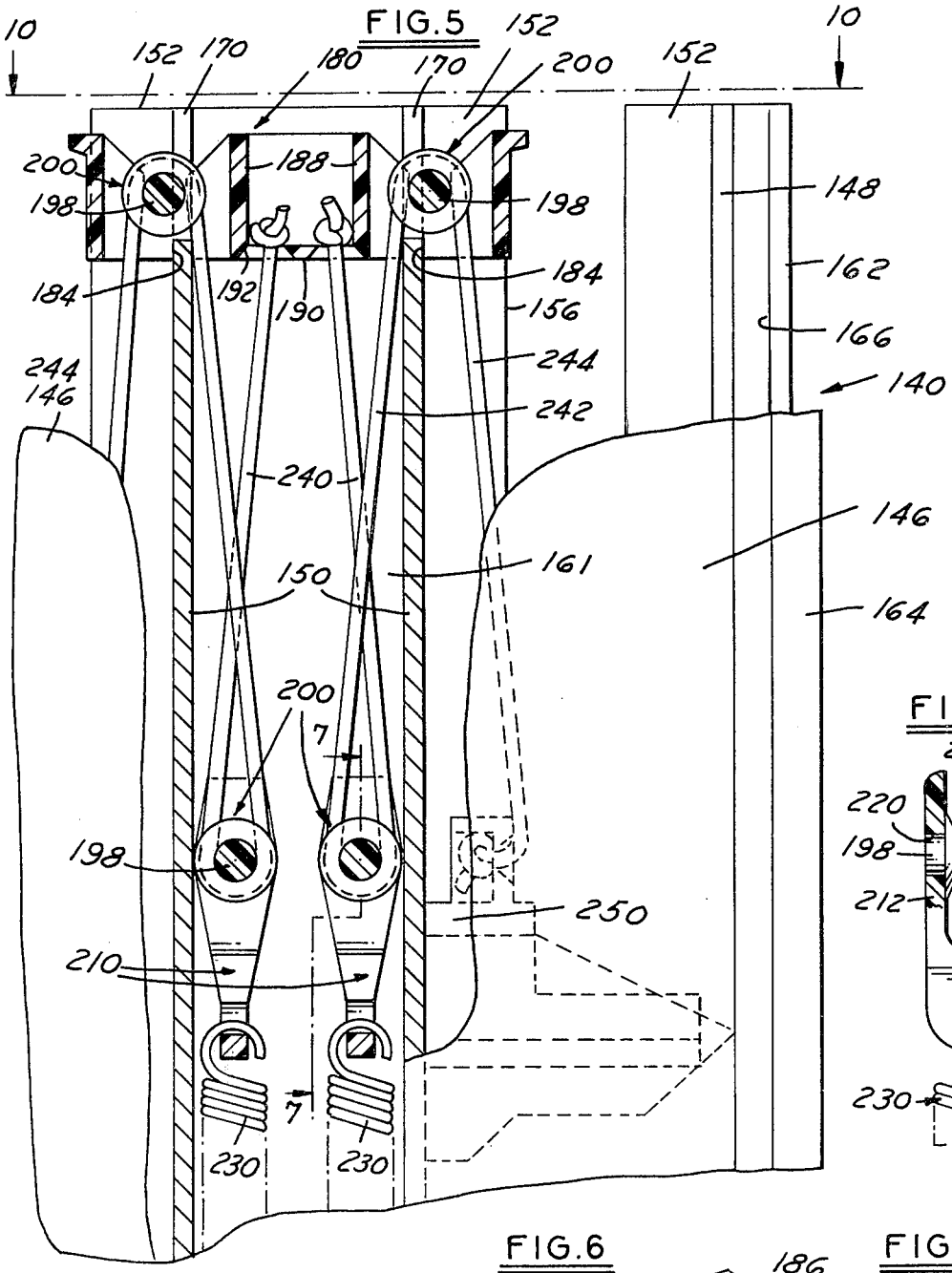
FIG. 5 is a view partially in section of a modified assembly.
Figure 10:
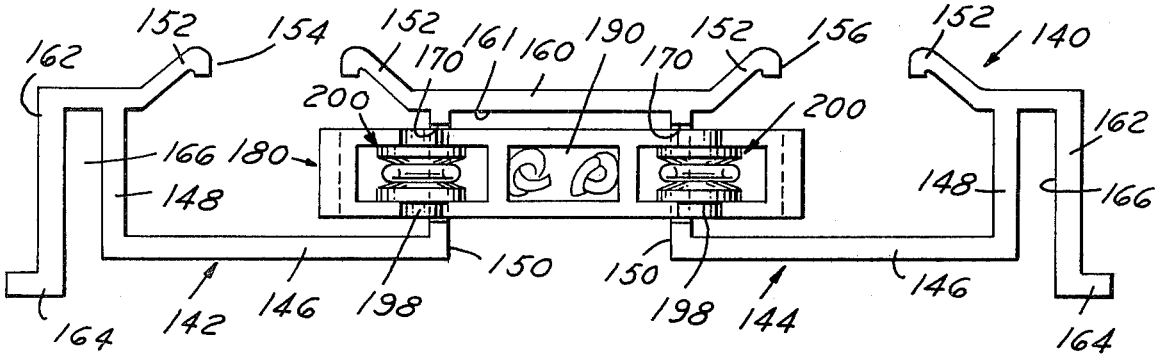
FIG. 10 is an end view of a window channel with the mounting element in place taken at line 10—10 of FIG. 5.

For a best understanding of this embodiment, reference is first made to FIG. 10, an end view of FIG. 5, which shows the configuration of a sash guide 140 as an extruded part preferably of plastic. Basically, this sash guide has two spaced, elongate, rectangular channels 142 and 144, each with a back face 146, outer sides 148 and inner, and spaced sides 150. The channels are partially closed on the front by side wings 152 which form elongate slots 154 and 156. These side wings 152 in opposed pairs form window guides for grooved window frames which slide up and down in the sash guide.

The two channels 142 and 144 are connected at the front by a central foreplate 160 which forms an elongate central channel 161 open at the back. Integral side runs 162 are spaced from walls 148 and flanged at 164. These flanges are spaced somewhat behind the back faces 146 to allow for an insulation strip which can be glued to the faces 146 and pressed between the sash guide unit and a vertical side frame of a window opening. A spacer slot 166 thus is formed between walls 148 and 162.

In FIG. 5, the sash guide is viewed from the back, that is, from the bottom side as shown in FIG. 10. The two spaced central walls 150 are each notched out at the top to provide open-topped recesses 170 spaced across from each other.

Figure 6:
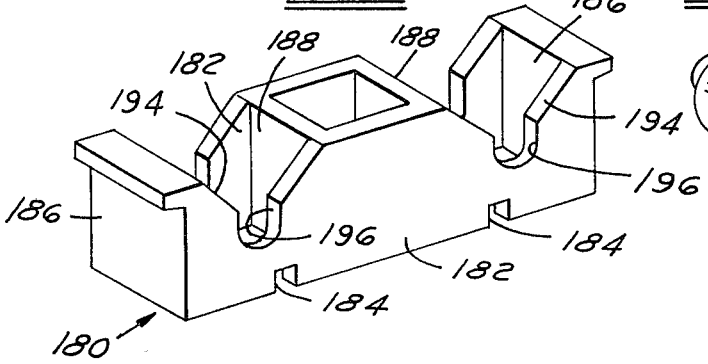
FIG. 6 is an isometric view of the bottom of a basic mounting element.
Figure 8:
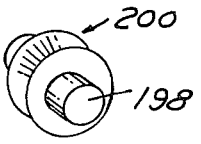
FIG. 8 is a view of a plastic pulley for use in both the mounting element and the traveling pulley.
Figure 9:
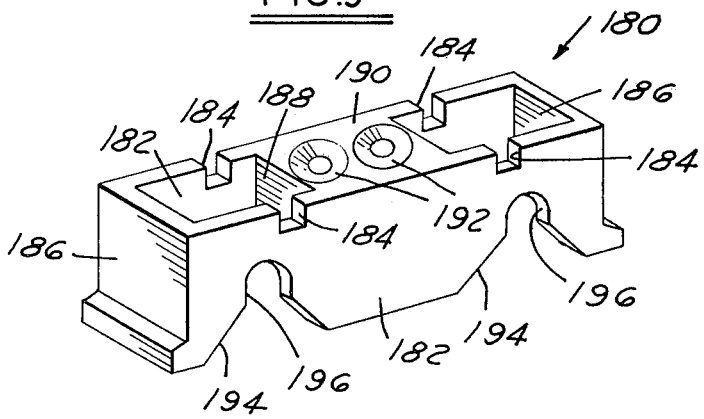
FIG. 9 is an isometric view of the top of the mounting element.

Looking now at FIGS. 6 and 9, we see the top and bottom, respectively, of a mounting element in the form of a box-like structure 180. To give an idea of actual size, the entire width of the sash guide including flanges 164 is about 3⅝". The length of the mounting element 180 is about 1½", and the vertical height, 7/16", and the width ¼".

It will be seen from FIGS. 6 and 9 that the longitudinal walls 182 of the element 180 have spaced notches 184. The notches interfit with walls 150 of the sash guide unit within the recesses 170 as shown in FIG. 5 to stabilize the element 180 at the top of the sash guide.

The side walls 182 of the element 180 are joined by end walls 186 and by intermediate walls 188. The side walls and the intermediate walls form a central box like well with a bottom 190 perforated by two holes 192. As shown in FIG. 5, these holes receive the ends of the cable runs, the ends being knotted, to provide anchor points for the cables. The side walls 182 are also provided with opposed pairs of notches 194 which reduce down to shaft journals 196 for the protruding axles 198 of small pulleys 200 about 9/32" in diameter.

Figure 7:
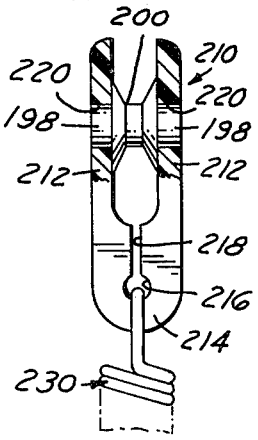
FIG. 7 is a partial section of a traveling pulley.

In FIG. 7, a travelling pulley element 210 is illustrated. This is a U-shaped integral molded element which has spaced legs 212 connected by a bight portion 214 having an eye 216 below a slot 218. The legs 212 have opposed holes 220 to receive the axles 198 of a pulley 200, the same pulley as used in the mounting element. The eye 216 is provided to receive the hooked end of a balancing spring 230.

The element 210 is molded out of dense plastic such as nylon or Teflon and can be spread apart to allow the pulleys 200 to be mounted between the legs 212.

In the assembly drawing of FIG. 5, the various elements above described are shown in the respective functional positions.

The mounting element 180 is securely positioned in the slots 170 and notches 184 against transverse dislocation. Single or double balance window frames can be used. In FIG. 5, double pulley assemblies are shown. Anchor runs 240 are anchored by knots in openings 192. These runs pass around pulleys 200 in traveling pulley elements 210 and then up in runs 242 to pulleys 200 in the mounting element 180. Descending runs 244 are at a sash coupling 250 as shown, for example, in U.S. Pat. to Trout, U.S. Pat. No. 3,197,819 (Aug. 3, 1965) or as shown in FIG. 4 herein at 100. Springs 230, previously referenced, are suitably anchored at the bottom of the sash guide.

I claim:

1. A self-contained spring-stretch-reducing sash balance construction for double-hung, sliding sash windows to be mounted in and between laterally spaced opposite vertical sides of a sliding sash window frame, that improvement which comprises:

(a) a separately mountable, elongate slide housing for at least one side of the window having a back face portion to lie along the side of a window frame. said slide housing having a closed front center panel to be spaced outwardly from the back face to form a first, central, elongate, vertical chamber open at the back, and spaced, parallel, elongate sash guides spaced laterally to each side of said center panel, each sash guide being slotted lengthwise and spaced outwardly from the back face of the housing to provide a vertical reentrant retaining guide track chamber for a sash coupling element with common vertical walls between said central chamber and said guide track chambers, (b) a sash balance header element supported horizontally at the top and within the confines of said slide housing having spaced pulley chambers formed therein at the top of and open to said vertical chamber and said guide track chambers, (c) a stationary pulley rotatably supported in each said pulley chamber above said respective guide tracks in said slide housing, (d) elongate balancing springs disposed in parallel spaced relation in said central vertical chamber anchored at one end adjacent the bottom of said slide housing with movable ends extending up into said central vertical chamber, (e) a traveling pulley element affixed to the upper ends of each of said springs, and (f) a flexible cable on each side of said slide housing having a fixed end anchored centrally of said header above said central vertical chamber and a movable end connected to sash coupling elements in the respective vertical guide track chambers, each said cable having a first section in said central vertical chamber extending from said header to and around said traveling pulley and a second section in said vertical chamber extending from said first section beyond said traveling pulley into one of the spaced header vertical guide track chambers around a stationary pulley above said chambers, and a third section in a guide track chamber extending from said second section beyond said stationary pulley to a sash coupling in said respective guide track chambers.

2. A device as defined in claim 1 in which said header element comprises an integral molded element in the form of a rectangular box having side walls, end walls, and transverse intermediate walls parallel to said end walls, said side walls and said intermediate walls forming a central well, and a perforate bottom in said well to serve as an anchor point for each said cable, said side walls beyond said intermediate walls being notched from the top to provide spaced bearing journals, and pulleys in said header having integral axles journaled in said notches and pulley sheaves between said side walls.

3. A device as defined in claim 2 in which the top of the said common walls between said chambers are notched downwardly and the bottom of said side walls of said header element are notched upwardly so said walls can interengage to stabilize said header element in said slide housing.

4. A device as defined in claim 1 in which said traveling pulley element comprises an integral U-shaped plastic element having a bight portion to engage a balancing spring and spaced legs with opposed axle journal openings and resiliently spreadable to allow insertion of a pulley having integral axles at each side to seat and run in said journal openings.

* * * * *